US007080516B2

(12) United States Patent
Pidcock et al.

(10) Patent No.: US 7,080,516 B2
(45) Date of Patent: Jul. 25, 2006

(54) GAS DIFFUSION ARRANGEMENT

(75) Inventors: Anthony Pidcock, Derby (GB); Desmond Close, Derby (GB)

(73) Assignee: Rolls-Royce plc, London (GB)

( * ) Notice: Subject to any disclaimer, the term of this patent is extended or adjusted under 35 U.S.C. 154(b) by 14 days.

(21) Appl. No.: 10/742,811

(22) Filed: Dec. 23, 2003

(65) Prior Publication Data

US 2004/0195396 A1 Oct. 7, 2004

(30) Foreign Application Priority Data

Jan. 18, 2003 (GB) ..... 0301185.5

(51) Int. Cl.
*F02C 1/00* (2006.01)
*F02G 3/00* (2006.01)

(52) U.S. Cl. ..... 60/751; 60/748

(58) Field of Classification Search ..... 60/751, 60/722, 804, 726, 728, 737, 748; 415/83, 415/208.1, 210.1
See application file for complete search history.

(56) References Cited

U.S. PATENT DOCUMENTS 2,570,155 A * 10/1951 Redding ..... 138/39
4,315,405 A * 2/1982 Pidcock et al. ..... 60/752
4,356,693 A * 11/1982 Jeffery et al. ..... 60/39.37
4,380,895 A * 4/1983 Adkins ..... 60/39.23
5,077,967 A * 1/1992 Widener et al. ..... 60/772
5,211,003 A * 5/1993 Samuel ..... 60/772
5,246,338 A * 9/1993 Takayanagi et al. ..... 415/208.1
5,335,501 A * 8/1994 Taylor ..... 60/751
5,592,821 A 1/1997 Alary
5,619,855 A * 4/1997 Burrus ..... 60/736
6,082,966 A * 7/2000 Hall et al. ..... 415/209.1
6,286,298 B1 * 9/2001 Burrus et al. ..... 60/776
6,295,801 B1 * 10/2001 Burrus et al. ..... 60/776
6,651,439 B1 * 11/2003 Al-Roub et al. ..... 60/772

FOREIGN PATENT DOCUMENTS

GB 2 054 047 A 2/1981
GB 1 594 463 SP 7/1981
GB 2 109 103 A 5/1983

* cited by examiner

*Primary Examiner*—William Rodriguez
(74) *Attorney, Agent, or Firm*—W. Warren Taltavull; Manelli Denison & Selter PLLC

(57) ABSTRACT

A gas diffusion arrangement (22) for a gas turbine engine (10) is disclosed. The gas diffusion arrangement (22) has an inlet (26) and an outlet (28) for the gas, and comprises diffusion means (32) having an upstream region (38) and a downstream region (40). Distribution means (41) is arranged between the downstream region (40) and the outlet (28) to distribute the gas into a desired flow pattern. The area ratio of the cross-sectional area of the downstream region (40) to the cross-sectional area of the upstream region (38) is greater than 1.5 to 1.

23 Claims, 7 Drawing Sheets

GAS DIFFUSION ARRANGEMENT

FIELD OF THE INVENTION

This invention relates to gas diffusion arrangements. More particularly, the invention relates to gas diffusion arrangements for gas turbine engines.

BACKGROUND OF THE INVENTION

There is a desire in the aerospace industry to move towards gas turbine engines which reduce the amount of $NO_x$ emissions. In order to achieve this, lean burn combustion processes are required, so as to limit the flame temperature in the combustor, and hence limit $NO_x$ production. In order to achieve these reduced temperatures, most of the combustion air has to be burnt in the combustor, with little remaining for cooling the combustor walls.

The fuel injectors required for such lean burn combustors are larger than the injectors for conventional combustors. As a result, the conventional diffuser for feeding the air from the compressor to the combustor is inadequate.

SUMMARY OF THE INVENTION

According to one aspect of this invention there is provided a gas diffusion arrangement for a gas turbine engine, the diffusion arrangement having an inlet and an outlet for the gas and comprising diffusion means having an upstream inlet region and a downstream outlet region, and distribution means arranged between the downstream outlet region of the diffusion arrangement and said outlet to distribute the gas into a desired flow pattern.

Preferably, the area ratio of the cross-sectional area of the downstream region to the cross-sectional area of the upstream region is greater than 1.5 to 1.

Desirably, the aforesaid area ratio is greater than 2 to 1, and preferably greater than 3 to 1. The aforesaid area ratio is desirably 4 to 1, and may be greater than 4 to 1.

Preferably, the diffusion means comprises an expansion chamber. In the expansion chamber gas from an upstream region preferably undergoes major expansion. The diffusion means is preferably annular in configuration.

The gas distribution arrangement may comprise a pre-diffuser upstream of the gas diffusion member.

Preferably, the walls of the diffusion means flare outwardly from each other. Advantageously, the walls of the diffusion means flare outwardly to a greater degree than the walls of the pre-diffuser.

Preferably, the distribution means defines a plurality of pathways for the gas. The distribution means may define a plurality of apertures, wherein said apertures define the pathways. Preferably, the distribution means comprises a grid member.

Preferably, the distribution means comprises an annular array of said apertures and may be annular in configuration. The distribution means may be formed of a plurality of segments, for example four. The distribution means may comprise a plate, which may have a thickness which is equal to the length of said pathways.

The apertures may be of constant cross-section, or they may be of aerodynamic configuration. In the case of apertures being of aerodynamic configuration, the apertures are preferably of a generally frustoconical configuration, where the cross-sectional area of the pathways increases in a downstream direction.

Preferably, the apertures have a convergent upstream region. The apertures may have a divergent downstream region. The distribution means may include portions between adjacent apertures. Each portion may comprise an upstream nose which may be convex. Preferably, the convergent region of each aperture is adjacent the respective noses of the distribution means. In another embodiment, the aperture may have a convergent upstream region and a parallel downstream region.

The distribution means may define apertures which have differing cross-sectional configurations to each other. In one embodiment, some of the apertures may be of a constant cross-section and others may be of a frustoconical configuration. Preferably, the apertures of constant cross-section extend centrally around the annular part of the distribution means, and the apertures of frustoconical configuration may be arranged at inner and outer regions of the annular grid.

The size of the apertures may vary across the distribution means. In one embodiment, the apertures may be of a smaller size in a central region of the annular part, and may be of a larger size at inner and outer regions of the annular part.

In one embodiment, the distribution means may comprise a protruding portion which extends in an upstream direction. In this embodiment, the annular grid member is of an ogive configuration.

In the preferred embodiment, the cross-sectional area of the downstream region of the diffusion means is greater than the cross-sectional area of an injection module for a combustor. Preferably, the cross-sectional area of the downstream region of the diffusion member is at least two times the cross-sectional area of the injection module for the combustor.

According to another aspect of this invention, there is provided a combustion arrangement comprising a combustor, a fuel injection module and a gas diffusion arrangement as described above.

According to another aspect of this invention, there is provided a gas turbine engine incorporating a combustion arrangement as described above.

BRIEF DESCRIPTION OF THE DRAWINGS

Embodiments of the invention will now be described by way of example only, with reference to the accompanying drawings, in which.

DETAILED DESCRIPTION OF THE INVENTION

Figure 1:
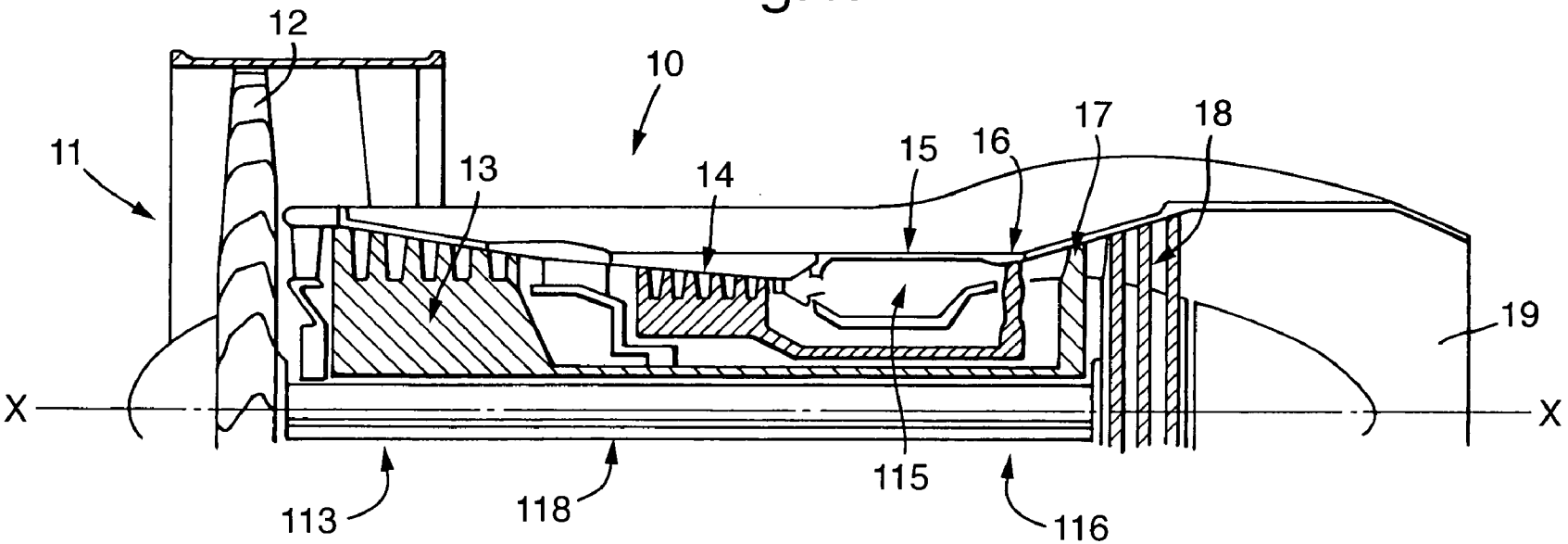
FIG. 1 is a schematic sectional side view of the upper half of a gas turbine engine.

With reference to FIG. 1, a ducted fan gas turbine engine generally indicated at 10 has a principal axis X—X. The engine 10 comprises, in axial flow series, an air intake 11, a propulsive fan 12, a compressor region 113 comprising an intermediate pressure compressor 13, and a high pressure compressor 14, combustion means 115 comprising a combustor 15, and a turbine region 116 comprising a high pressure turbine 16, an intermediate pressure turbine 17, and a low pressure turbine 18. An exhaust nozzle 19 is provided at the tail of the engine 10.

The gas turbine engine 10 works in the conventional manner so that air entering the intake 11 is accelerated by the fan to produce two air flows: a first air flow into the intermediate pressure compressor 13 and a second air flow which provides propulsive thrust. The intermediate pressure compressor 13 compresses the air flow directed into it before delivering the air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive the high, intermediate and low pressure turbine 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 118. Each of the shafts connecting the respective turbines with the respective compressors is formed of a plurality of shaft segments which are axially coupled together.

Figure 2:
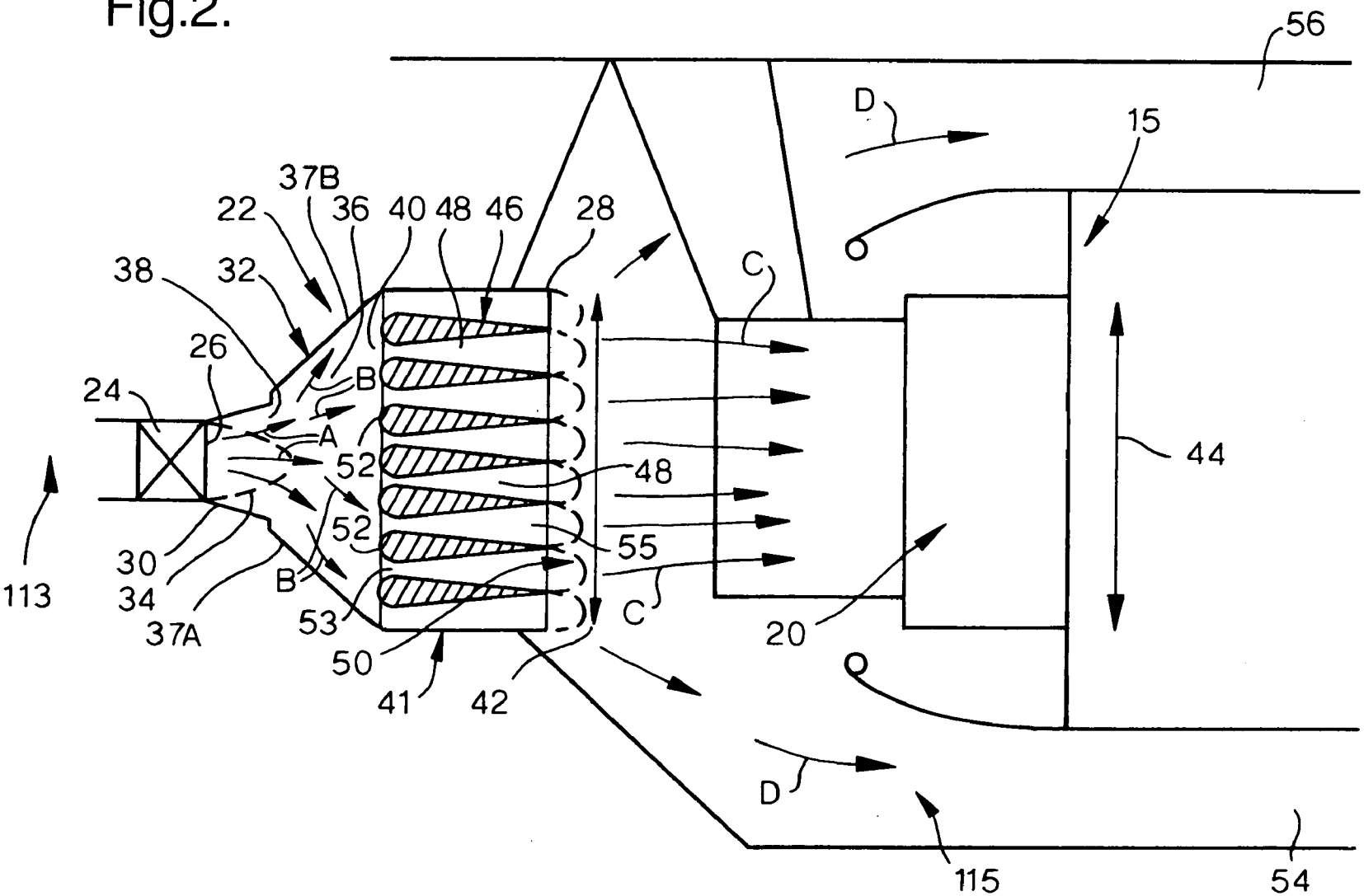
FIG. 2 is a sectional side view of an upper part of a combustor arrangement incorporating a diffuser arrangement.

Referring to FIG. 2, there is shown in more detail the combustion arrangement 115 which comprises the combustor 15, a fuel injection module 20 and a gas diffusion arrangement 22 arranged downstream of the compressor region 113. A nozzle guide vane 24 is provided downstream of the compressor region 113 to direct air into the gas diffusion arrangement 22.

The gas diffusion arrangement 22 comprises an inlet 26 and an outlet 28. A prediffuser 30 extends from the inlet 26 to diffusion means 32. The prediffuser 30 acts to direct air from the compressor arrangement 113 into the diffusion means 32, as shown by the arrows A. The velocity profile of air passing through the prediffuser 30 is shown by the dotted lines designated 34. A distribution means 41 is provided downstream of the diffuser means 32 to receive air therefrom.

The diffusion means 32 comprises an expansion chamber 36 having inner and outer annular outwardly flared walls 37A, 37B respectively. The inner and outer walls 37A, 37B extend around the principal axis X—X of the gas turbine engine 10A The expansion chamber 36 has an upstream inlet region 38 and a downstream outlet region 40. The upstream region 38 is provided adjacent the prediffuser 30, and the downstream region 40 is provided adjacent the distribution means 41. Air flowing through the diffuser means 32 is shown by the arrows B.

The area ratio of the cross-sectional area of the downstream outlet region 40 to the cross-sectional area of the upstream inlet region 38 is about 4 to 1. As can be seen from FIG. 2, the diameter of the distribution member 41, as indicated by the numeral 42 is the same as the diameter of the downstream outlet region 40 of the diffusion means 32. Also the diameter of the module 20, as indicated by the numeral 44 is generally the same as the diameter 42 of the distribution member 41. Thus, air exiting from the distribution member 41 is substantially uniformly distributed across the outlet 28, thereby feeding the module 20 uniformly.

The distribution means 41 is in the form of a grid member 46 defining a plurality of apertures 48 defining pathways for the air through the distribution means 41.

The distribution means 41 acts to distribute the air impinging upon it generally uniformly across its surface at the downstream region of the diffusion member 32. Each of the apertures 48 shown in FIG. 2 is of a generally conical configuration and act to recover the flow dynamic pressure and minimise flow velocity prior to exiting the diffusion arrangement 22 at the outlet 28. The numeral 50 designates the velocity profile of air exiting the diffusion arrangement 22 from each respective aperture 48 at the outlet 28.

A major proportion of the air exiting the diffusion arrangement 22 is directed through the fuel injection module 20. However, some of the air exiting from the diffusion arrangement 22 at the edge regions thereof, as shown by the arrows D are directed inwardly and outwardly of the combustor 15 to inner and outer annuli 54, 56 and can be used for other purposes, for example as cooling air. The provision of the diffusion arrangement 22 allows the flow of air as indicated by the arrows B to be more uniform than with the prior art. The air directed into the combustor 15 is designated by the arrow C.

The grid member 46 comprises regions between the apertures 48 which are in the form aerodynamic convex noses 52. The purpose of the convex noses 52 is to attempt to accommodate flow mis-matches and to minimise pressure loss. The noses 52 also act to redistribute air across the downstream region 40 of the diffusion means 32 so that there is a substantially uniform flow of air through the apertures 48. The noses 52 provide the apertures 48 in FIG. 2 with a convergent upstream region 53.

Figure 3:
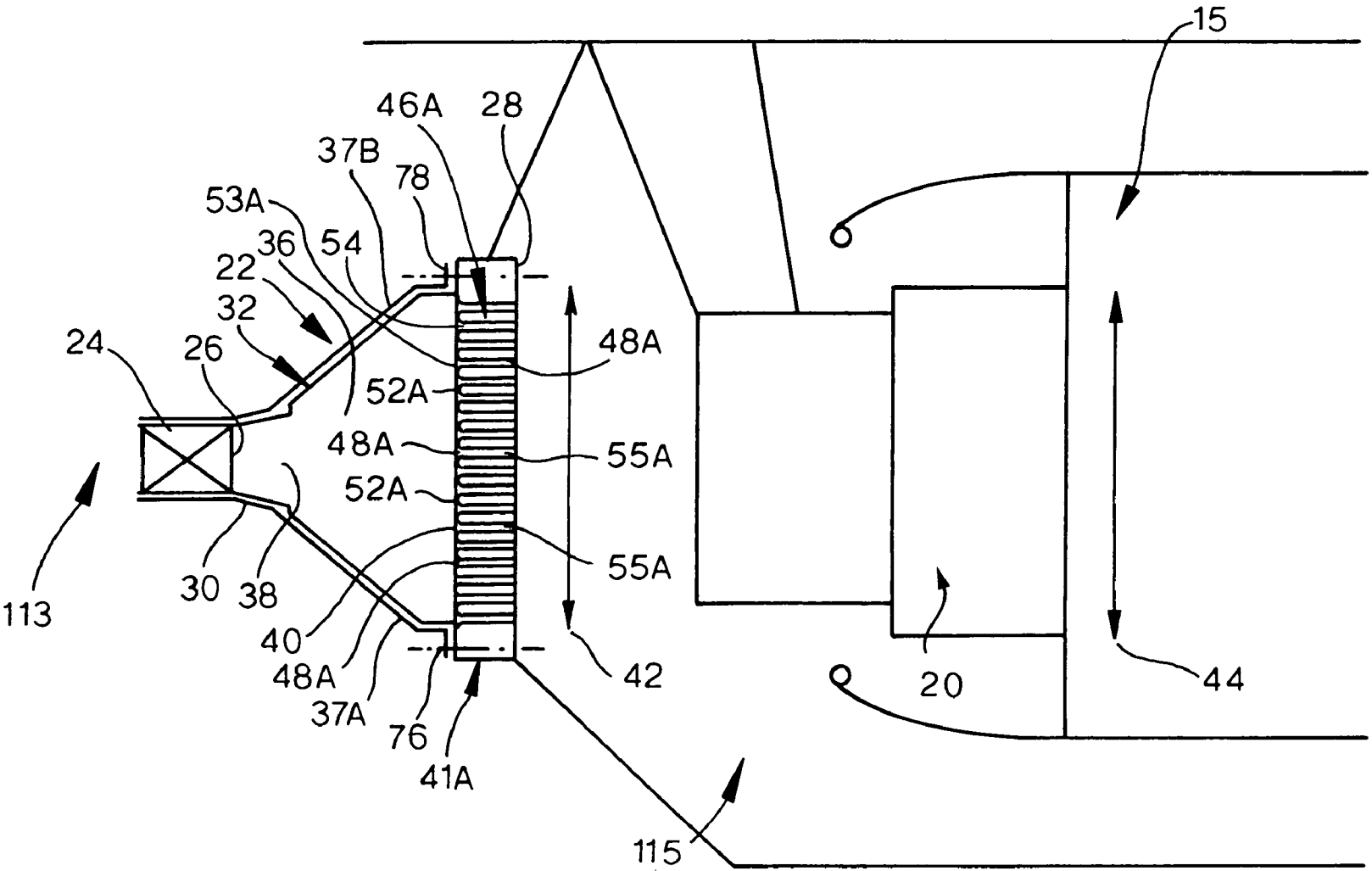
FIG. 3 is a sectional side view of the upper part of a combustor arrangement incorporating another embodiment of a diffuser arrangement.

Referring to FIG. 3, there is shown a further embodiment which is similar to the embodiment shown in FIG. 2, and the same features have been designated with the same reference numeral. The embodiment shown in FIG. 3 differs from that shown in FIG. 2 in that the distribution member (designated 46A) is different and is described below.

The distribution member 41A shown in FIG. 3 comprises a grid member 46A having a plurality of apertures 48A having a divergent upstream region 53A adjacent the noses 52A, and a generally parallel region 55A downstream of the divergent region 53A. Thus, the downstream region 55A of each aperture 48A is generally of a constant cross-section. Also, it will be seen that the apertures 48A are generally narrower than the apertures 48 shown in FIG. 2.

Figure 4:
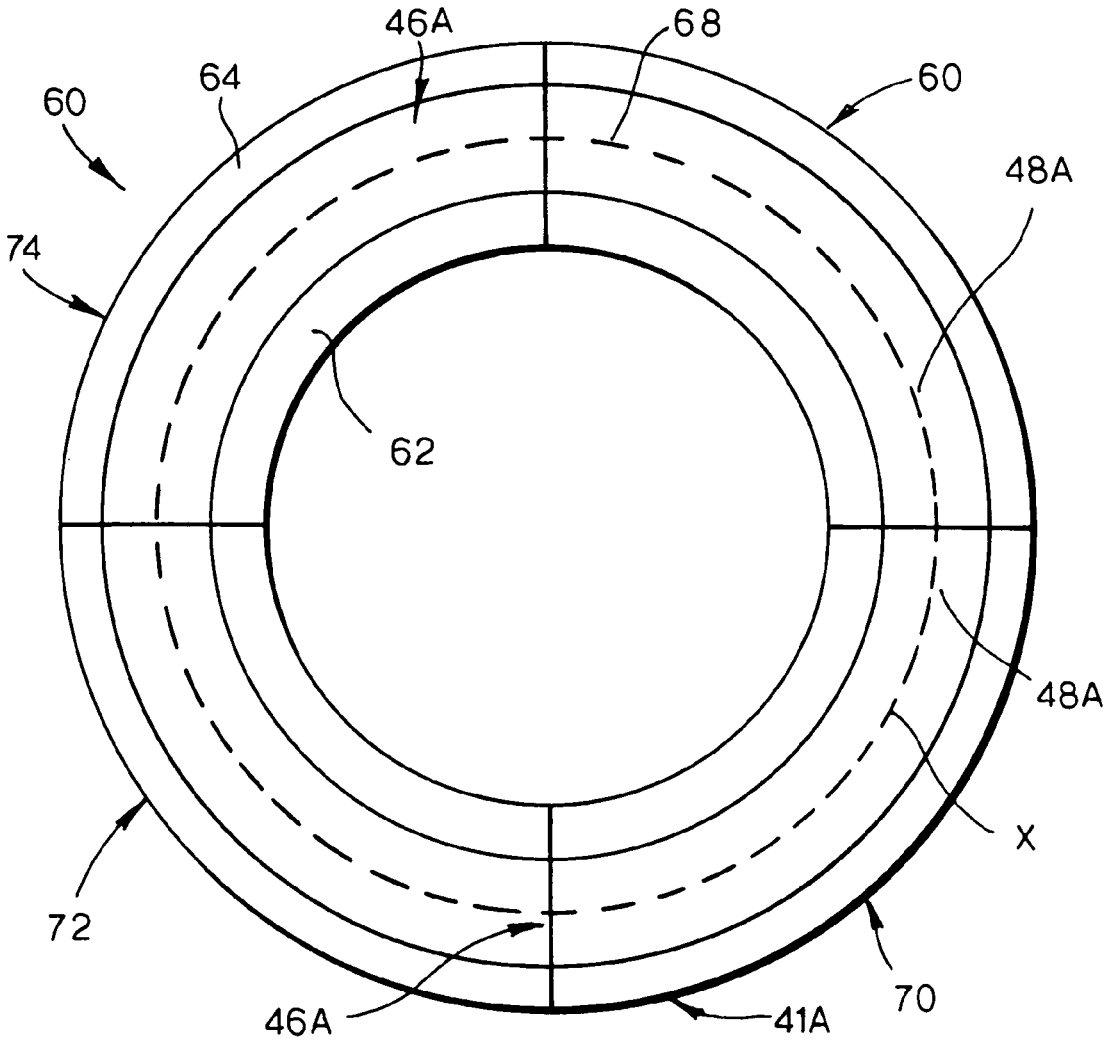
FIG. 4 shows a view in a downstream direction of a grid member.

Referring to FIG. 4, there is shown a view from a downstream direction of the distribution member 41A. The distribution member 41A is in the form of an annular plate 60 comprising inner and outer annular connecting portions 62, 64 and the grid member 46A. The grid member 46A comprises an array 67 of the apertures 48 (represented by the dots). The annular grid member 46A has an annular central line X.

As shown in FIG. 4, the plate 60 comprises four segments 68, 70, 72 and 74. Each of these segments 68 to 74 comprises a quarter of the annular plate 60 and can be attached separately to the diffusion member 32. The inner and outer connecting portions 62, 64 of each of the segments 68 to 74 define a plurality of bolt apertures (not shown). Referring to FIG. 3, the diffusion member 32 comprises inwardly and outwardly extending flange members 76, 78 with corresponding bolt apertures (not shown) defined therein, such that the bolt apertures in the inner and outer connecting portions 62, 64 can be aligned with the bolt apertures in the inner and outer flanges 76, 78 of the diffusion 32 and bolts inserted therethrough to attach the plate 60 to the diffusion means 32.

Figure 5:
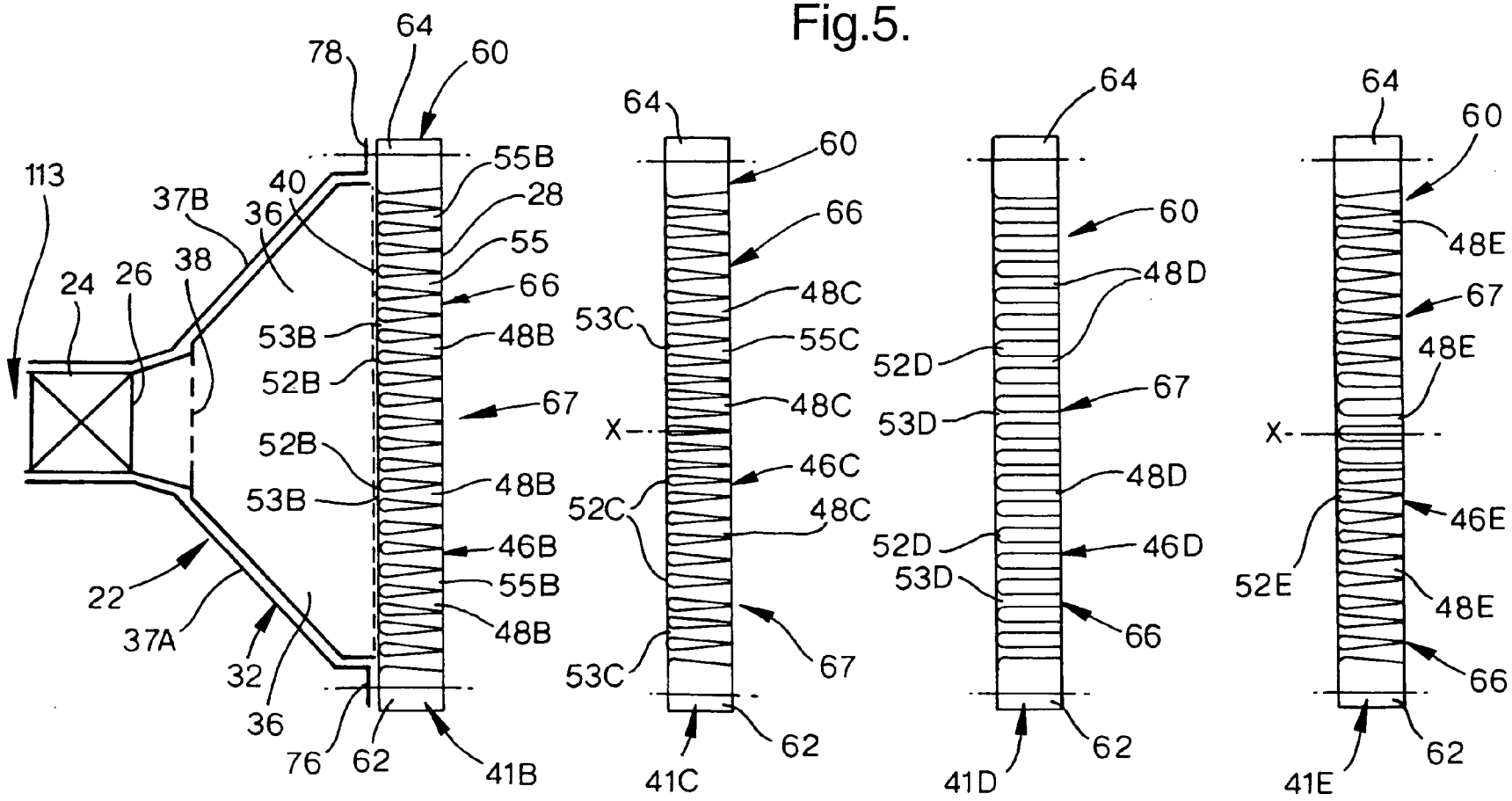
FIG. 5 shows a sectional side view of a diffuser arrangement incorporating one embodiment of a distribution arrangement, and also shows sectional side views of further embodiments of the distribution arrangement.

FIG. 5 shows a diffusion arrangement 22 comprising features as described with reference to FIGS. 2 and 3 and, again, these have been designated with the same reference numeral. The diffusion arrangement 22 in FIG. 5 comprises a grid member 46B comprising apertures 48B. The apertures 48B are of a generally uniform size and a uniform distribution across the distribution.

Also shown in FIG. 5 are alternative versions of the member, which are designated respectively 46C, 46D and 46E. The grid member 46C comprises frustoconical apertures 48C which vary in size and in distance from each other across the grid. Generally, the apertures 48A are closer together closest to the centre line X of the distribution member 46C, and are further away from each other at the edge regions of the grid member 46C.

The grid member designated 46D defines apertures 48D, which comprise a divergent upstream region 53D adjacent the noses 52, and a generally parallel region 55D downstream of the divergent region 53D. Thus, the downstream regions 55D are of a generally constant cross-section and constant distance from each other across the grid member 46D.

The grid member 46E comprises apertures 48E, which are a combination of the configurations of the apertures 48B of the distribution member 41B and the apertures 48D of the grid member 46D, i.e. the apertures 48B are of a generally constant cross-section closer to the centre line X, but become of a frustoconical configuration towards the inner and outer edges of the grid member 46E.

Figure 6:
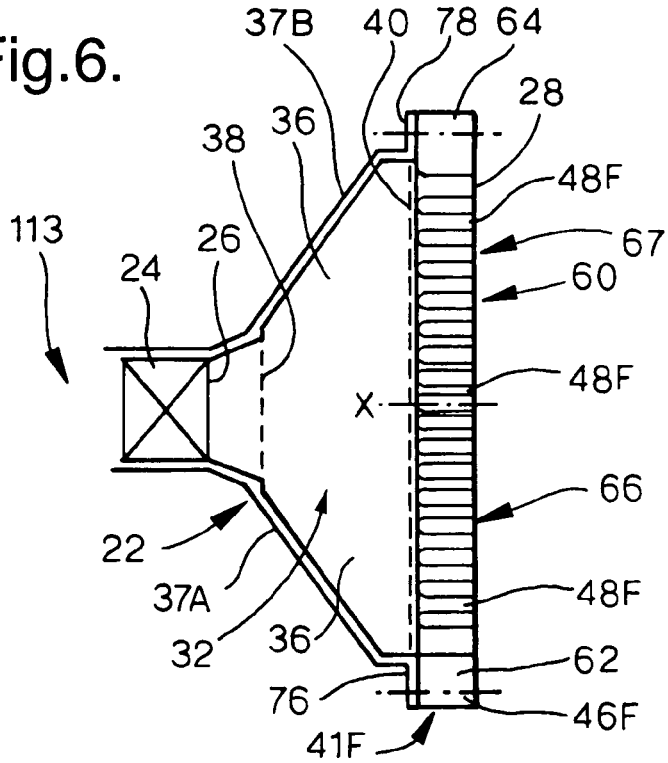
FIG. 6 shows a sectional side view of a diffuser arrangement with a further embodiment of the distribution arrangement.

Referring to FIG. 6, there is shown a further diffusion arrangement 22 which comprises a grid member 46F having apertures 48F of constant cross-section, but which increase in size from the centre X to the edges thereof.

Figure 7:
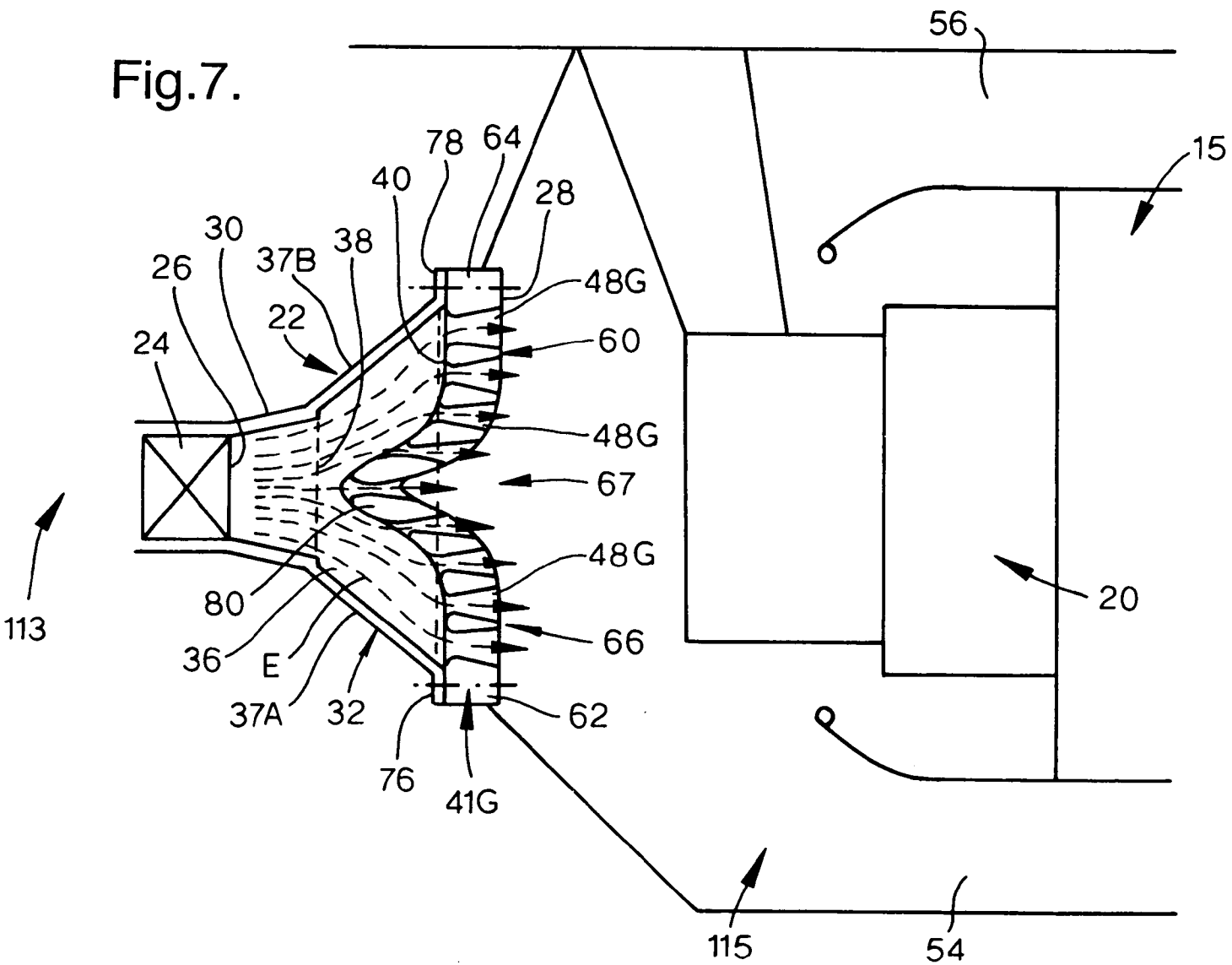
FIG. 7 shows a sectional side view of the upper part of a combustor arrangement with a further embodiment of a diffuser arrangement.

FIG. 7 shows a further embodiment of a diffuser arrangement 22 in a combustor arrangement 115. FIG. 7 is similar to the embodiments shown in FIGS. 2 and 3, and the same features have been designated with the same reference numerals.

The grid member shown in FIG. 7 is designated 46G and defines apertures 48G differs from the grid members 46 to 46F shown in FIGS. 2 to 6 in that the central part 66 of the grid member 46G is provided with an upstream extending projection in the form of an ogive 80. In FIG. 7, the apertures 48G defined in the grid member 46G have an aerodynamic configuration to recover some of the pressure lost in the diffusion member 32. In the embodiment shown in FIG. 7, the downstream region 40 of the diffusion means 32 extends directly from the inner flange 76 to the outer flange 78 and is not dependent upon the shape of central part 66 of the distribution means 41G.

By providing a distribution member of the shape shown in FIG. 7, the advantage is provided of minimising system length and pressure loss. Also, the ogive 80 assists in turning the flow of air (represented by the arrows E) towards the edge regions of the annular central part 66 of the plate 60 thereby improving the uniformity of flow through the apertures 48G, as compared with the embodiments shown in FIGS. 2–6.

Figure 8:
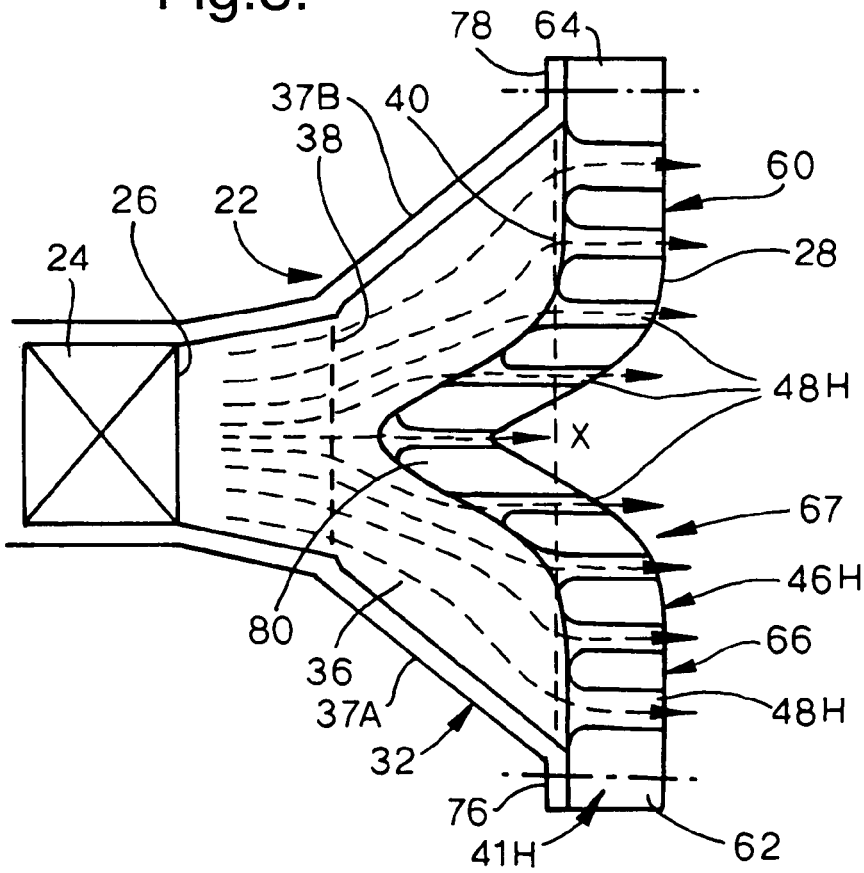
FIG. 8 shows a sectional side view of a diffuser arrangement incorporating a further embodiment of a distribution member.

FIG. 8 shows a diffusion member which is similar to that shown in FIG. 7 in that it includes a distribution member with a projection in the form of an ogive 80. The distribution member 41H comprises the grid member 46H, which defines apertures 48H. However, in the embodiment shown in FIG. 8, the apertures 48H are of uniform cross-section, but increase in diameter from the annular centre line X of the inner and outer edges thereof.

The grid members 46 to 46H have the advantage that they can carry structural loads. Thus, the overall weight of using the grid diffusers is not significantly different from prior art arrangements.

Various modifications can be made without departing from the scope of the invention.

It will be appreciated that the distribution of air exiting the distribution means 41 need not be uniform circumferentially. In certain circumstances it may be advantageous to increase the flow are per unit length at the exit to the distribution means 41 in line with the fuel injection module 20.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A gas diffusion arrangement for a gas turbine engine having an injection module for a combustor, the diffusion arrangement having an inlet and an outlet for a gas and comprising diffusion means having an upstream inlet region and a downstream outlet region, and distribution means arranged between the downstream outlet region of said diffusion means and said outlet of said diffusion arrangement to distribute the gas into a desired flow pattern wherein said distribution means comprises a grid member characterised in that a cross-sectional area of the downstream outlet region of the diffusion means is greater than a cross-sectional area of said injection module for a combustor.

2. A gas diffusion arrangement according to claim 1 characterised in that an area ratio of a cross-sectional area of the downstream outlet region to a cross-sectional area of the upstream inlet region is greater than 1.5 to 1.

3. A gas diffusion arrangement according to claim 1, characterised in that an area ratio of a cross-sectional area of the downstream outlet region to a cross-sectional area of the upstream inlet region is greater than 2 to 1.

4. A gas diffusion arrangement according to claim 1, characterised in that an area ratio of a cross-sectional area of the downstream outlet region to a cross-sectional area of the upstream inlet region is greater than 3 to 1.

5. A gas diffusion arrangement according to claim 1, characterised in that an area ratio of a cross-sectional area of the downstream outlet region to a cross-sectional area of the upstream inlet region is substantially 4 to 1.

6. A gas diffusion arrangement according to claim 1, characterised in that an area ratio of a cross-sectional area of the downstream outlet region to a cross-sectional area of the upstream inlet region is greater than 4 to 1.

7. A gas diffusion arrangement according to claim 1, characterised in that the distribution means defines a plurality of apertures defining pathways for a gas through the distribution means.

8. A gas diffusion arrangement according to claim 7, characterised in that the distribution means comprises an annular array of apertures.

9. A gas diffusion arrangement according to claim 7, characterised in that the distribution means comprises a plate having a thickness equal to the length of the pathways.

10. A gas diffusion arrangement according to claim 7, characterised in that the apertures are of constant cross-section, or of aerodynamic configuration.

11. A gas diffusion arrangement according to claim 1, characterised in that the distribution means comprises a plurality of segments.

12. A gas diffusion arrangement according to claim 1, characterised in that the distribution means comprises a protruding portion which extends in an upstream direction.

13. A gas diffusion arrangement according to claim 12, characterised in that the protruding portion extends around an annular centre line along a central part thereof.

14. A gas diffusion arrangement according to claim 1, characerised in that a cross-sectional area of the downstream outlet region of the diffusion means is at least two times a cross-sectional area of the injection module.

15. A gas diffusion arrangement according to claim 1, characterised in that the diffusion means comprises an expansion chamber, in which gas from an upstream region undergoes a major expansion, wherein a plurality of walls of a diffusion member flare outwardly from each other in a downstream direction.

16. A combustion arrangement comprising a combustor, a fuel injection module and a gas diffusion arrangement as claimed in claim 1.

17. A gas turbine engine incorporating a combustion arrangement as claimed in claim 16.

18. A gas diffusion arrangement for a gas turbine engine, the diffusion arrangement having an inlet and an outlet for a gas and comprising diffusion means having an upstream inlet region and a downstream outlet region, and distribution means arranged between the downstream outlet region of said diffusion means and said outlet of said diffusion arrangement to distribute the gas into a desired flow pattern wherein the distribution means defines a plurality of apertures defining pathways for the gas through the distribution means wherein the apertures are of constant cross-section and of aerodynamic configuration and the apertures are of a generally frustoconical configuration, such that the cross-sectional area of the pathways increases in a downstream direction characterised in that the apertures have a convergent upstream region and a divergent downstream region wherein the distribution means includes portions between adjacent apertures with each portion comprising an upstream convex nose.

19. A gas diffusion arrangement according to claim 18, characterised in that the convergent region of each aperture is adjacent the respective noses of the distribution means.

20. A gas diffusion arrangement according to claim 18, characterised in that the distribution means defines apertures which have differing cross-sectional configurations to each other.

21. A gas diffusion arrangement according to claim 20, characterised in that some of the apertures are of a constant cross-section and others are of a frustoconical configuration, the apertures of constant cross-section extending centrally around an annular array and the apertures of frustoconical configuration being arranged at inner and outer regions of the annular array.

22. A gas diffusion arrangement according to claim 18, characterised in that the size of the apertures varies across the distribution means.

23. A gas diffusion arrangement according to claim 22, characterised in that the apertures are of a smaller size in a central region of an annular array, and are of a larger size at inner and outer regions of the annular array.

* * * * *